US007438242B2

(12) United States Patent
Ciampolini

(10) Patent No.: US 7,438,242 B2
(45) Date of Patent: Oct. 21, 2008

(54) ELECTROMAGNETICALLY ACTUATED FUEL INJECTOR

(75) Inventor: Franco Ciampolini, Bologna (IT)

(73) Assignee: Magneti Marelli Holding S.p.A., Corbetta (IT)

( * ) Notice: Subject to any disclaimer, the term of this patent is extended or adjusted under 35 U.S.C. 154(b) by 404 days.

(21) Appl. No.: 11/188,224

(22) Filed: Jul. 22, 2005

(65) Prior Publication Data

US 2006/0022072 A1 Feb. 2, 2006

(30) Foreign Application Priority Data

Jul. 23, 2004 (IT) ..... BO2004A0466

(51) Int. Cl.
*F02M 51/00* (2006.01)

(52) U.S. Cl. ..... 239/585.4; 239/533.11; 239/533.12; 239/567; 239/600; 239/900; 239/DIG. 4; 239/DIG. 19; 277/591; 277/598

(58) Field of Classification Search ..... 239/533.11, 239/533.12, 548, 567, 585.1, 585.4, 585.5, 239/600, 900, DIG. 4, DIG. 19; 277/591, 277/598

See application file for complete search history.

(56) References Cited

U.S. PATENT DOCUMENTS

| | | | | |
|---|---|---|---|---|
| 5,626,292 | A * | 5/1997 | Armaroli et al. | 239/600 |
| 6,027,050 | A | 2/2000 | Rembold et al. | 239/585.5 |
| 6,302,337 | B1 | 10/2001 | Kimmel | 239/408 |
| 6,755,360 | B1 * | 6/2004 | Anderson et al. | 239/585.1 |
| 6,851,622 | B2 * | 2/2005 | Demere et al. | 239/900 |
| 6,918,550 | B2 * | 7/2005 | Luft | 239/585.1 |
| 7,063,279 | B2 * | 6/2006 | Mizuno et al. | 239/585.1 |
| 7,140,556 | B2 * | 11/2006 | Cristiani et al. | 239/533.11 |
| 7,252,249 | B2 * | 8/2007 | Molnar | 239/DIG. 19 |
| 2002/0145060 | A1 | 10/2002 | Mills et al. | 239/585.1 |
| 2004/0011899 | A1 | 1/2004 | Dantes et al. | 239/585.1 |

FOREIGN PATENT DOCUMENTS

| | | |
|---|---|---|
| EP | 0 508 188 A2 | 10/1992 |
| EP | 0 921 302 A1 | 6/1999 |
| EP | 1 036 932 A2 | 9/2000 |
| GB | 269735 | 4/1927 |
| GB | 2 107 809 A | 5/1983 |
| JP | 60212669 | 10/1985 |
| WO | WO 01/29395 A2 | 4/2001 |

* cited by examiner

*Primary Examiner*—Steven J Ganey
(74) *Attorney, Agent, or Firm*—Perman & Green, LLP

(57) ABSTRACT

A fuel injector having an injection nozzle; an injection valve having a movable pin for regulating fuel flow through the injection nozzle; an electromagnetic actuator for moving the pin between a closed position and an open position respectively closing and opening the injection valve; and a tubular supporting body, which has a central channel for feeding pressurized fuel to the injection nozzle, and houses the electromagnetic actuator, the injection valve, and the pin; the supporting body is formed by joining a one-piece tubular top member housing the electromagnetic actuator and made of high-tensile steel with poor magnetic characteristics, and a one-piece tubular bottom member housing the injection valve and made of a low-thermal-expansion alloy.

46 Claims, 4 Drawing Sheets

ELECTROMAGNETICALLY ACTUATED FUEL INJECTOR

CROSS-REFERENCE TO RELATED APPLICATIONS

This patent application claims priority from Italian Patent Application No. BO2004A 000466 filed on Jul. 23, 2004.

BACKGROUND OF THE INVENTION

1. Field of the Invention

The present invention relates to an electromagnetically actuated fuel injector.

2. Brief Description of Related Developments

An electromagnetic fuel injector normally comprises a tubular supporting body having a central channel, which acts as a fuel conduit and terminates in an injection nozzle regulated by an injection valve controlled by an electromagnetic actuator. The injection valve has a pin connected rigidly to a movable armature of the electromagnetic actuator, and which is moved by the electromagnetic actuator between a closed position and an open position respectively closing and opening the injection nozzle in opposition to a spring which keeps the pin in the closed position.

One example of an electromagnetic fuel injector of the above type is described in U.S. Pat. No. 6,027,050-A1, which relates to a fuel injector having a pin which cooperates at one end with a valve seat, and is integral at the opposite end with a movable armature of an electromagnetic actuator; the pin is guided by the armature at the top, and at the bottom by the end portion of the pin sliding inside a guide portion of the valve seat.

Known electromagnetic fuel injectors of the above type are widely used, by combining good performance and low cost. Since injectors with an electromagnetically actuated pin, however, are unable to operate at very high fuel pressures, injectors with a hydraulically operated pin have been proposed, i.e. in which movement of the pin from the closed to the open position, in opposition to the spring, is produced by hydraulic forces. Examples of such injectors are described in Patent Applications EP-1036932-A2, EP-0921302-A2, and WO-0129395-A1.

Though of good dynamic performance and capable of operating at very high fuel pressures, injectors with a hydraulically actuated pin are complicated and expensive to produce, by requiring a hydraulic circuit with a piezoelectrically or electromagnetically actuated control valve. Moreover, there is always a certain amount of backflow of fuel, which is drained at ambient pressure, and which has the negative effects of constituting a loss of energy, and of tending to heat the fuel.

When assembled in an injection system, the injector is connected to a pressurized-fuel feed conduit. More specifically, the tubular supporting body of the injector is connected in fluidtight manner to the feed conduit to connect the central channel of the supporting body hydraulically to the feed conduit. The fluidtight connection is normally made using a connector, which provides for a conical connection with no elastic seals, i.e. an inclined surface of the supporting body is kept pressed against a corresponding inclined surface of the connector with no elastic seal in between. However, to ensure long-term sealing of such connections, even in the presence of continuous vibration (typical of an internal combustion engine), the component parts, particularly the inclined surfaces pressed against each other, call for extremely precise machining, and as such are time-consuming and expensive to produce.

SUMMARY OF THE INVENTION

It is an object of the present invention to provide an electromagnetically actuated fuel injector designed to eliminate the aforementioned drawbacks, and which, in particular, is cheap and easy to produce.

According to the present invention, there is provided an electromagnetically actuated fuel injector, as recited in the accompanying claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
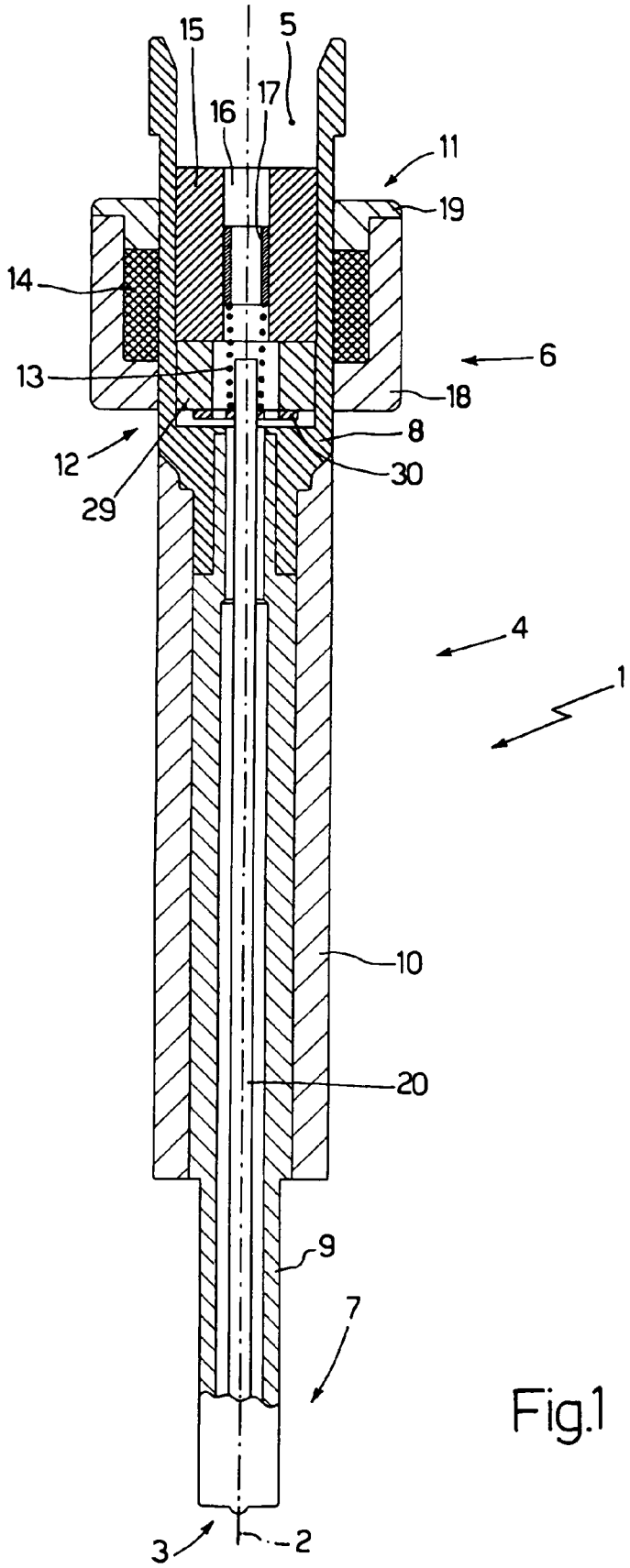
FIG. 1 shows a schematic, partly sectioned, side view of a fuel injector in accordance with the present invention.

Number 1 in FIG. 1 indicates as a whole a fuel injector, which is cylindrically symmetrical about a longitudinal axis 2, and is controlled to inject fuel from an injection nozzle 3. Injector 1 comprises a cylindrical tubular supporting body 4 varying in section along longitudinal axis 2, and having a central channel 5 extending the full length of supporting body 4 to feed pressurized fuel to injection nozzle 3. Supporting body 4 houses an electromagnetic actuator 6 in a top portion, and an injection valve 7 in a bottom portion. In actual use, injection valve 7 is activated by electromagnetic actuator 6 to regulate fuel flow through injection nozzle 3, which is formed at injection valve 7.

Supporting body 4 is formed by connection of a one-piece tubular top member 8, housing electromagnetic actuator 6, to a one-piece tubular bottom member 9, housing injection valve 7. Tubular top member 8 preferably comprises a cylindrical, internally threaded seat for receiving a threaded portion of tubular bottom member 9. A one-piece cylindrical sleeve 10, preferably made of plastic material, such as PEEK 30 CF, may be fitted about part of tubular top member 8 and part of tubular bottom member 9 to relieve tubular bottom member 9 of the axial and transverse loads (e.g. tightening stress) to which injector 1 is subjected.

Electromagnetic actuator 6 comprises an electromagnet 11 housed in a fixed position inside supporting body 4, and which, when excited, moves an armature 12 of ferromagnetic material along axis 2 from a closed position to an open position to open injection valve 7 in opposition to a spring 13 which keeps armature 12 in the closed position closing injection valve 7. Electromagnet 11 comprises a dry coil 14 powered electrically by an electronic control unit (not shown) and located outside supporting body 4; and a magnetic core 15 housed inside supporting body 4 and having a central hole 16 to permit fuel flow to injection nozzle 3. A cylindrical tubular retaining body 17 is fitted in a fixed position inside central hole 16 in magnetic core 15 to permit fuel flow to injection nozzle 3 and to keep spring 13 pressed against armature 12.

Magnetic core 15 is preferably connected to supporting body 4 by an annular weld inside supporting body 4.

Coil 14 of electromagnet 11 is housed inside a tubular seating body 18, which is closed at the bottom, surrounds supporting body 4, and is welded to supporting body 4 by an annular weld. At the top, seating body 18 is closed by an annular plug 19 welded to seating body 18 to isolate coil 14 inside seating body 18. It is important to note that, by virtue of its location, coil 14 dissipates considerable heat, and is isolated from the fuel and so unaffected by the mechanical effect and chemical aggression produced by the pressurized fuel.

Armature 12 forms part of a movable assembly, which also comprises a shutter or pin 20 having a top portion integral with armature 12, and a bottom portion cooperating with a valve seat 21 (FIG. 2) of injection valve 7 to regulate fuel flow through injection nozzle 3 in known manner.

Figure 2:
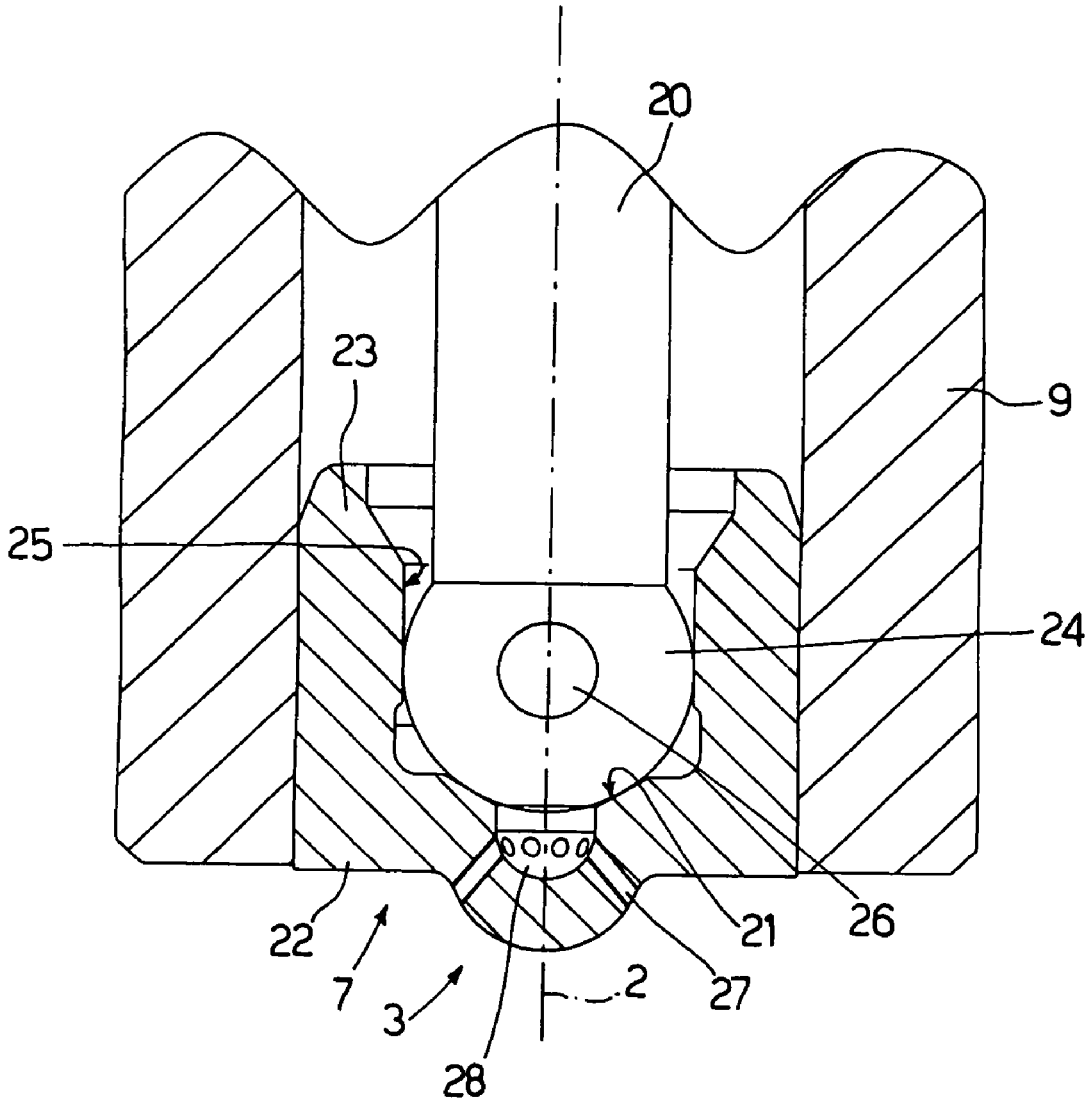
FIG. 2 shows a larger-scale view of an injection valve of the FIG. 1 injector.

As shown in FIG. 2, valve seat 21 is defined by a disk-shaped sealing member 22, which closes the bottom of central channel 5 of supporting body 4 in fluidtight manner, and through which injection nozzle 3 extends. A tubular guide member 23 extends upwards from disk-shaped sealing member 22, houses pin 20 to define a bottom guide of pin 20, and has an outside diameter substantially equal to the inside diameter of central channel 5 of supporting body 4.

Pin 20 terminates with a substantially spherical shutter head 24, which rests in fluidtight manner on valve seat 21. Shutter head 24 also rests in sliding manner against a cylindrical inner surface 25 of guide member 23, by which it is guided in its movement along longitudinal axis 2. Recesses 26 (only one shown in FIG. 2) are formed in shutter head 24 to define, between each recess 26 and cylindrical inner surface 25 of guide member 23, a fuel flow passage to injection nozzle 3. In a preferred embodiment shown in FIG. 2, injection nozzle 3 is defined by a number of through holes 27 extending from a hemispherical chamber 28 formed downstream from valve seat 21.

As shown in FIG. 1, armature 12 is a one-piece body, and comprises an annular member 29; and a disk-shaped member 30, which closes the underside of annular member 29, and in turn comprises a central through hole for receiving a top portion of pin 20, and a number of peripheral through holes (only two shown in FIG. 1) to permit fuel flow to injection nozzle 3. A central portion of disk-shaped member 30 is shaped to receive and hold in position a bottom end of spring 13. Pin 20 is preferably made integral with disk-shaped member 30 of armature 12 by an annular weld.

The outside diameter of annular member 29 of armature 12 is substantially equal to the inside diameter of the corresponding portion of central channel 5 of supporting body 4, so that armature 12 can slide with respect to supporting body 4 along longitudinal axis 2, but is prevented from moving crosswise to longitudinal axis 2 with respect to supporting body 4. Pin 20 being connected rigidly to armature 12, armature 12 therefore also acts as a top guide for pin 20, which is therefore guided at the top by armature 12 and at the bottom by guide member 23.

In an alternative embodiment not shown, a bounce-damping device is connected to the underside face of disk-shaped member 30 of armature 12 to reduce bounce of shutter head 24 of pin 20 on valve seat 21 when pin 20 moves from the open position to the closed position closing injection valve 7.

In actual use, when electromagnet 11 is deenergized, armature 12 is not attracted by magnetic core 15, and the elastic force of spring 13 pushes armature 12, together with pin 20, downwards, so that shutter head 24 of pin 20 is pressed against valve seat 21 of injection valve 7 to isolate injection nozzle 3 from the pressurized fuel. Conversely, when electromagnet 11 is energized, armature 12 is attracted magnetically by magnetic coil 15 in opposition to the elastic force of spring 13, and armature 12, together with pin 20, moves up into contact with magnetic core 15, so that shutter head 24 of pin 20 is lifted off valve seat 21 of injection valve 7, thus permitting pressurized-fuel flow through injection nozzle 3.

As shown clearly in FIG. 1, tubular bottom member 9 is much longer than tubular top member 8, and houses almost the whole of pin 20, which is the mechanical member responsible for opening and closing injection valve 7. To avoid the negative effects produced by thermal expansion, both tubular bottom member 9 and pin 20 are made of a low-thermal-expansion alloy, in particular INVAR 36. Cylindrical sleeve 10, on the other hand, performs purely mechanical functions, to relieve tubular bottom member 9 of the axial and transverse loads to which injector 1 is subjected in use, and is therefore made of ordinary stainless steel.

Tubular top member 8 is preferably made of high-tensile stainless steel with poor magnetic characteristics (i.e. non-magnetic, and therefore of low magnetic permeability comparable to that of air). An iron-cobalt alloy, such as hardened and tempered ISI 440C, may be used, for example. Seating body 18, annular plug 19, magnetic core 15, and armature 12 (or at least tubular member 9 of armature 12) are made of magnetic stainless steel (i.e. with a much higher magnetic permeability than air), such as VACUFLUX 50.

In an alternative embodiment not shown, supporting body 4 is formed in one piece and made entirely of high-tensile stainless steel with poor magnetic characteristics.

Injector 1 as described above is cheap and easy. to produce, by being formed by connecting a small number of parts, each of which is cylindrically symmetrical and therefore easy to produce by means of standard, easily automated turning operations involving no dedicated tooling. Moreover, simulation and testing have shown injector 1 as described above to be capable of operating at very high fuel pressures (close to 1000 bars) while still maintaining excellent dynamic performance (i.e. precise injection times).

Figure 3:
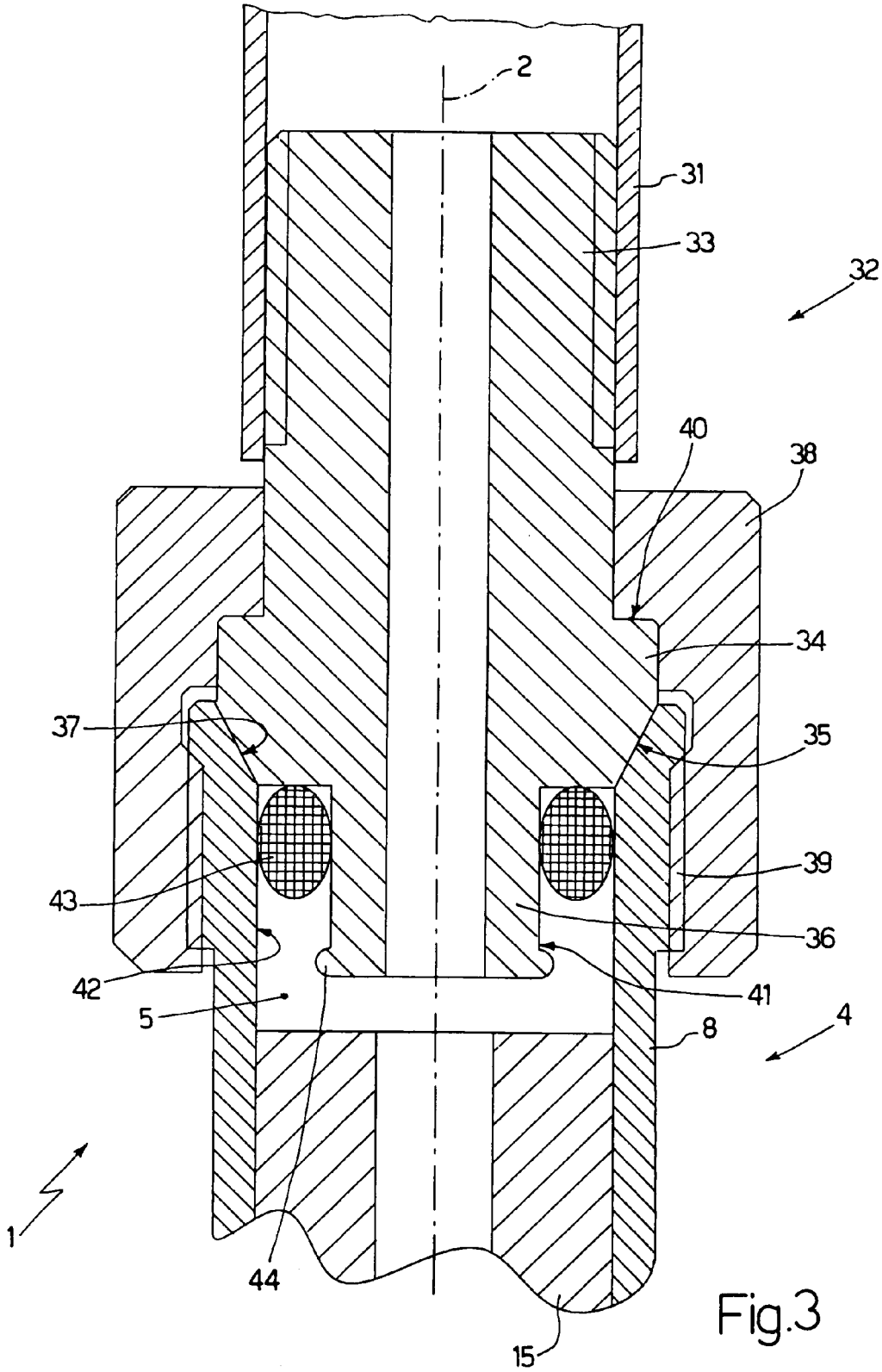
FIG. 3 shows a larger-scale view of a connecting device fitted to the FIG. 1 injector.
Figure 4:
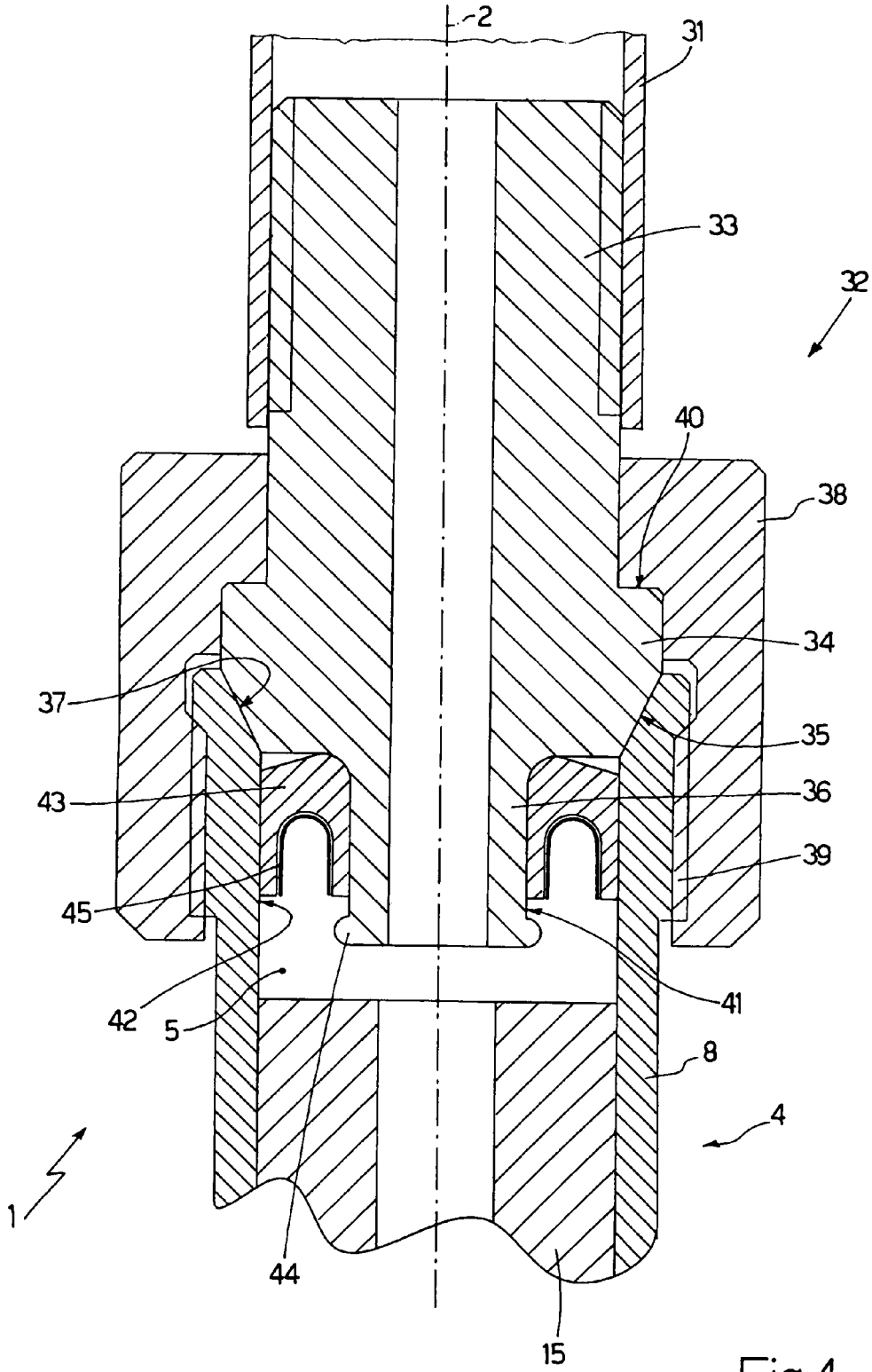
FIG. 4 shows an alternative embodiment of the FIG. 3 connecting device.

As shown in FIGS. 3 and 4, supporting body 4 of injector 1 is connected to a pressurized-fuel feed conduit 31 by means of a connector 32. More specifically, supporting body 4 is connected in fluidtight manner to feed conduit 31 to connect central channel 5 of supporting body 4, hydraulically to feed conduit 31.

Connector 32 is cylindrically symmetrical about longitudinal axis 2, and comprises a cylindrical top member 33, which is substantially equal in outside diameter to the inside diameter of feed conduit 31, and has a threaded outer end portion which screws inside feed conduit 31. Connector 32 also comprises a central member 34 larger in outside diameter than top member 33 and terminating with a truncated-cone-shaped surface 35; and a cylindrical bottom member 36 smaller in outside diameter than the inside diameter of central channel 5 of supporting body 4, and which is located inside central channel 5. For this purpose, the top end of supporting body 4 has a truncated-cone-shaped surface 37, which is positioned contacting truncated-cone-shaped surface 35 of central member 34 of connector 32.

To keep connector 32 pressed against supporting body 4, an annular fastening member 38 is screwed to a threaded outer surface 39 of supporting body 4 so as to contact, with a given pressure, an annular top surface 40 of central member 34 of connector 32.

An elastic annular seal 43 is fitted between an outer surface 41 of bottom member 36 and an inner surface 42 of central channel 5. To facilitate assembly of annular seal 43, bottom member 36 terminates with an annular enlargement 44 for retaining seal 43 on bottom member 36 during assembly.

In the FIG. 3 embodiment, annular seal 43 is an O-ring seal made of elastic polymer material and having a solid oval-shaped cross section.

In the FIG. 4 embodiment, annular seal 43 is a lip seal made of elastic polymer material and having a partly hollow, inverted-U-shaped cross section. An annular, inverted-U-shaped spring 45 is preferably inserted inside annular lip seal 43, and may be made of metal or elastomer.

Connector 32 as described above provides for ensuring long-term sealing, even in the presence of continuous vibration, and is cheap and easy to produce, by the component parts not requiring particularly accurate machining.

The invention claimed is:

1. A fuel injector (1) comprising:

an injection nozzle (3);

an injection valve (7) having a movable pin (20) for regulating fuel flow through the injection nozzle (3);

an electromagnetic actuator (6) for moving the pin (20) between a closed position and an open position respectively closing and opening the injection valve (7); and a tubular supporting body (4), which has a central channel (5) extending the full length of the supporting body (4) to feed pressurized fuel to the injection nozzle (3), and houses the electromagnetic actuator (6), the injection valve (7), and the pin (20); the supporting body (4) has a tubular top member (8) housing the electromagnetic actuator (6), and a tubular bottom member (9) housing the injection valve (7);

the injector (1) being characterized in that the tubular top member (8) of the supporting body (4) is made of high-tensile steel with poor magnetic characteristics;

wherein the supporting body (4) is formed by joining the tubular top member (8), which is formed in one-piece, and the tubular bottom member (9), which is also formed in one piece; and wherein the tubular top member (8) has a cylindrical seat, which is threaded internally to receive a threaded portion of the tubular bottom member (9).

2. An injector (1) as claimed in claim 1, wherein the tubular bottom member (9) and the pin (20) are made of a low-thermal-expansion alloy.

3. An injector (1) as claimed in claim 2, wherein the tubular bottom member (9) and the pin (20) are made of INVAR.

4. An injector (1) as claimed in claim 3, wherein the tubular bottom member (9) and the pin (20) are made of INVAR 36.

5. An injector (1) as claimed in claim 1, wherein the tubular top member (8) is made of an iron-cobalt alloy.

6. An injector (1) as claimed in claim 1, wherein a one-piece cylindrical sleeve (10) surrounds part of the tubular top member (8) and part of the tubular bottom member (9).

7. An injector (1) as claimed in claim 6, wherein the cylindrical sleeve (10) is made of plastic material.

8. An injector (1) as claimed in claim 1, wherein the electromagnetic actuator (6) comprises a coil (14), a fixed magnetic core (15), and an armature (12) which is attracted magnetically by the magnetic core (15), in opposition to a spring (13), and is connected mechanically to the pin (20); the magnetic core (15), the armature (12), and the spring (13) are housed inside the central channel (5) of the supporting body (4); and the coil (14) is housed inside a tubular seating body (18) located outside the supporting body (4) and surrounding the supporting body (4).

9. An injector (1) as claimed in claim 8, wherein the seating body (18), the magnetic coil (15), and the armature (12) are made of magnetic steel.

10. An injector (1) as claimed in claim 8, wherein the armature (12) comprises an annular member (29); and a disk-shaped member (30), which closes the underside of the annular member (29), and in turn comprises a central through hole for receiving a top portion of the pin (20), and a number of peripheral through holes to permit fuel flow to the injection nozzle (3).

11. An injector (1) as claimed in claim 1, wherein the pin (20) comprises an elongated rod connected mechanically to the electromagnetic actuator (6); and a shutter head (24) which engages a valve seat (21) of the injection valve (7) in fluidtight manner.

12. An injector (1) as claimed in claim 1, wherein the injection valve (7) comprises a valve seat (21) defined by a disk-shaped sealing member (22), through which the injection nozzle (3) extends; and a tubular guide member (23) extends upwards from the sealing member (22), and houses the pin (20) to define a bottom guide of the pin (20).

13. An injector (1) as claimed in claim 1, wherein a connector (32) is provided to connect the central channel (5) of the supporting body (4) to a pressurized-fuel feed conduit (31); the connector (32) comprises a central member (34) larger in outside diameter than the supporting body (4), and a cylindrical bottom member (36) having an outside diameter smaller than the inside diameter of the central channel (5) of the supporting body (4), and which is housed inside the central channel (5).

14. An injector (1) as claimed in claim 13, wherein the connector (32) comprises a cylindrical top member (33) having an outside diameter substantially equal to the inside diameter of the feed conduit (31), and comprising an externally threaded end portion which screws inside the feed conduit (31).

15. An injector (1) as claimed in claim 13, wherein the central member (34) terminates with a first truncated-cone-shaped surface (35); and the top end of the supporting body (4) has a second truncated-cone-shaped surface (37) which is positioned contacting the first truncated-cone-shaped surface (35) of the central member (34).

16. An injector (1) as claimed in claim 13, wherein an annular fastening member (38) is provided to keep the connector (32) pressed against the supporting body (4), and is screwed to a threaded outer surface (39) of the supporting body (4) so as to contact, with a given pressure, an annular top surface (40) of the central member (34) of the connector (32).

17. An injector (1) as claimed in claim 13, wherein an elastic annular seal (43) is inserted between an outer surface (41) of the bottom member (36) and an inner surface (42) of the central channel (5).

18. An injector (1) as claimed in claim 17, wherein the annular seal (43) is an O-ring seal made of elastic polymer material and having a solid, oval-shaped cross section.

19. An injector (1) as claimed in claim 17, wherein the annular seal (43) is a lip seal made of elastic polymer material and having a partly hollow, inverted-U-shaped cross section.

20. An injector (1) as claimed in claim 19, wherein an annular, inverted-U-shaped spring (45) is inserted inside the annular lip seal (43).

21. An injector (1) as claimed in claim 17, wherein the bottom member (36) of the connector (32) terminates with an annular enlargement (44) for retaining the annular seal (43) on the bottom member (36).

22. A fuel injector (1) comprising:

an injection nozzle (3);

an injection valve (7) having a movable pin (20) for regulating fuel flow through the injection nozzle (3);

an actuator (6) for moving the pin (20) between a closed position and an open position respectively closing and opening the injection valve (7);

a tubular supporting body (4), which has a central channel (5) extending the full length of the supporting body (4) to feed pressurized fuel to the injection nozzle (3), and houses the actuator (6), the injection valve (7), and the pin (20);

a connector (32) for connecting the central channel (5) of the supporting body (4) to a pressurized-fuel feed conduit (31);

wherein the connector (32) comprises a central member (34) larger in outside diameter than the supporting body (4), and a cylindrical bottom member (36) having an outside diameter smaller than the inside diameter of the central channel (5) of the supporting body (4), and which is housed inside the central channel (5); and an elastic annular seal (43) is inserted between an outer surface (41) of the bottom member (36) and an inner surface (42) of the central channel (5).

23. An injector (1) as claimed in claim 22, wherein the connector (32) comprises a cylindrical top member (33) having an outside diameter substantially equal to the inside diameter of the feed conduit (31), and comprising an externally threaded end portion which screws inside the feed conduit (31).

24. An injector (1) as claimed in claim 22, wherein the central member (34) terminates with a first truncated-cone-shaped surface (35); and the top end of the supporting body (4) has a second truncated-cone-shaped surface (37) which is positioned contacting the first truncated-cone-shaped surface (35) of the central member (34).

25. An injector (1) as claimed in claim 22, wherein an annular fastening member (38) is provided to keep the connector (32) pressed against the supporting body (4), and is screwed to a threaded outer surface (39) of the supporting body (4) so as to contact, with a given pressure, an annular top surface (40) of the central member (34) of the connector (32).

26. An injector (1) as claimed in claim 22, wherein the annular seal (43) is an O-ring seal made of elastic polymer material and having a solid, oval-shaped cross section.

27. An injector (1) as claimed in claim 22, wherein the annular seal (43) is a lip seal made of elastic polymer material and having a partly hollow, inverted-U-shaped cross section.

28. An injector (1) as claimed in claim 27, wherein an annular, inverted-U-shaped spring (45) is inserted inside the annular lip seal (43).

29. An injector (1) as claimed in claim 22, wherein the bottom member (36) of the connector (32) terminates with an annular enlargement (44) for retaining the annular seal (43) on the bottom member (36).

30. A fuel injector (1) comprising:

an injection nozzle (3);

an injection valve (7) having a movable pin (20) for regulating fuel flow through the injection nozzle (3);

an electromagnetic actuator (6) for moving the pin (20) between a closed position and an open position respectively closing and opening the injection valve (7); and a tubular supporting body (4), which has a central channel (5) extending the full length of the supporting body (4) to feed pressurized fuel to the injection nozzle (3), and houses the electromagnetic actuator (6), the injection valve (7), and the pin (20); the supporting body (4) has a tubular top member (8) housing the electromagnetic actuator (6), and a tubular bottom member (9) housing the injection valve (7);

wherein the tubular top member (8) of the supporting body (4) is made of high-tensile steel with poor magnetic characteristics, the supporting body (4) is formed by joining the tubular top member (8), which is formed in one-piece, and the tubular bottom member (9), which is also formed in one piece;

the tubular top member (8) has a cylindrical seat, which is threaded internally to receive a threaded portion of the tubular bottom member (9); and a one-piece cylindrical sleeve (10) surrounds part of the tubular top member (8) and part of the tubular bottom member (9).

31. The injector of claim 30 wherein the cylindrical sleeve (10) is made of plastic material.

32. A fuel injector (1) comprising:

an injection nozzle (3);

an injection valve (7) having a movable pin (20) for regulating fuel flow through the injection nozzle (3);

an electromagnetic actuator (6) for moving the pin (20) between a closed position and an open position respectively closing and opening the injection valve (7); and a tubular supporting body (4), which has a central channel (5) extending the full length of the supporting body (4) to feed pressurized fuel to the injection nozzle (3), and houses the electromagnetic actuator (6), the injection valve (7), and the pin (20); the supporting body (4) has a tubular top member (8) housing the electromagnetic actuator (6), and a tubular bottom member (9) housing the injection valve (7);

wherein the tubular top member (8) of the supporting body (4) is made of high-tensile steel with poor magnetic characteristics;

the supporting body (4) is formed by joining the tubular top member (8), which is formed in one-piece, and the tubular bottom member (9), which is also formed in one piece; and the tubular top member (8) has a cylindrical seat, which is threaded internally to receive a threaded portion of the tubular bottom member (9);

the electromagnetic actuator (6) comprises a coil (14), a fixed magnetic core (15), and an armature (12) which is attracted magnetically by the magnetic core (15), in opposition to a spring (13), and is connected mechanically to the pin (20); the magnetic core (15), the armature (12), and the spring (13) are housed inside the central channel (5) of the supporting body (4); and the coil (14) is housed inside a tubular seating body (18) located outside the supporting body (4) and surrounding the supporting body (4); and the armature (12) comprises an annular member (29); and a disk-shaped member (30), which closes the underside of the annular member (29), and in turn comprises a central through hole for receiving a top portion of the pin (20), and a number of peripheral through holes to permit fuel flow to the injection nozzle (3).

33. The injector of claim 32 wherein the pin (20) comprises an elongated rod connected mechanically to the electromagnetic actuator (6); and a shutter head (24) which engages a valve seat (21) of the injection valve (7) in fluidtight manner.

34. A fuel injector (1) comprising:

an injection nozzle (3);

an injection valve (7) having a movable pin (20) for regulating fuel flow through the injection nozzle (3);

an electromagnetic actuator (6) for moving the pin (20) between a closed position and an open position respectively closing and opening the injection valve (7); and a tubular supporting body (4), which has a central channel (5) extending the full length of the supporting body (4) to feed pressurized fuel to the injection nozzle (3), and houses the electromagnetic actuator (6), the injection valve (7), and the pin (20); the supporting body (4) has a tubular top member (8) housing the electromagnetic actuator (6), and a tubular bottom member (9) housing the injection valve (7);

wherein the tubular top member (8) of the supporting body (4) is made of high-tensile steel with poor magnetic characteristics;

the supporting body (4) is formed by joining the tubular top member (8), which is formed in one-piece, and the tubular bottom member (9), which is also formed in one piece;

the tubular top member (8) has a cylindrical seat, which is threaded internally to receive a threaded portion of the tubular bottom member (9); and a connector (32) is provided to connect the central channel (5) of the supporting body (4) to a pressurized-fuel feed conduit (31); the connector (32) comprises a central member (34) larger in outside diameter than the supporting body (4), and a cylindrical bottom member (36) having an outside diameter smaller than the inside diameter of the central channel (5) of the supporting body (4), and which is housed inside the central channel (5).

35. The injector of claim 34, wherein the connector (32) comprises a cylindrical top member (33) having an outside diameter substantially equal to the inside diameter of the feed conduit (31), and comprising an externally threaded end portion which screws inside the feed conduit (31).

36. The injector of claim 34, wherein the central member (34) terminates with a first truncated-cone-shaped surface (35); and the top end of the supporting body (4) has a second truncated-cone-shaped surface (37) which is positioned contacting the first truncated-cone-shaped surface (35) of the central member (34).

37. The injector of claim 34, wherein an annular fastening member (38) is provided to keep the connector (32) pressed against the supporting body (4), and is screwed to a threaded outer surface (39) of the supporting body (4) so as to contact, with a given pressure, an annular top surface (40) of the central member (34) of the connector (32).

38. The injector of claim 34, wherein an elastic annular seal (43) is inserted between an outer surface (41) of the bottom member (36) and an inner surface (42) of the central channel (5).

39. The injector of claim 34, wherein the annular seal (43) is an O-ring seal made of elastic polymer material and having a solid, oval-shaped cross section.

40. The injector of claim 34, wherein the annular seal (43) is a lip seal made of elastic polymer material and having a partly hollow, inverted-U-shaped cross section.

41. The injector of claim 34, wherein an annular, inverted-U-shaped spring (45) is inserted inside the annular lip seal (43).

42. The injector of claim 34, wherein the bottom member (36) of the connector (32) terminates with an annular enlargement (44) for retaining the annular seal (43) on the bottom member (36).

43. A fuel injector (1) comprising:

an injection nozzle (3);

an injection valve (7) having a movable pin (20) for regulating fuel flow through the injection nozzle (3);

an actuator (6) for moving the pin (20) between a closed position and an open position respectively closing and opening the injection valve (7);

a tubular supporting body (4), which has a central channel (5) extending the full length of the supporting body (4) to feed pressurized fuel to the injection nozzle (3), and houses the actuator (6), the injection valve (7), and the pin (20); and a connector (32) for connecting the central channel (5) of the supporting body (4) to a pressurized-fuel feed conduit (31);

wherein the connector (32) comprises a central member (34) larger in outside diameter than the supporting body (4), and a cylindrical bottom member (36) having an outside diameter smaller than the inside diameter of the central channel (5) of the supporting body (4), and which is housed inside the central channel (5);

an elastic annular seal (43) is inserted between an outer surface (41) of the bottom member (36) and an inner surface (42) of the central channel (5); and an annular fastening member (38) is provided to keep the connector (32) pressed against the supporting body (4), and is screwed to a threaded outer surface (39) of the supporting body (4) so as to contact, with a given pressure, an annular top surface (40) of the central member (34) of the connector (32).

44. The fuel injector of claim 43, wherein the connector (32) comprises a cylindrical top member (33) having an outside diameter substantially equal to the inside diameter of the feed conduit (31), and an externally threaded end portion which screws inside the feed conduit (31).

45. A fuel injector (1) comprising:

an injection nozzle (3);

an injection valve (7) having a movable pin (20) for regulating fuel flow through the injection nozzle (3);

an actuator (6) for moving the pin (20) between a closed position and an open position respectively closing and opening the injection valve (7);

a tubular supporting body (4), which has a central channel (5) extending the full length of the supporting body (4) to feed pressurized fuel to the injection nozzle (3), and houses the actuator (6), the injection valve (7), and the pin (20); and a connector (32) for connecting the central channel (5) of the supporting body (4) to a pressurized-fuel feed conduit (31);

wherein the connector (32) comprises a central member (34) larger in outside diameter than the supporting body (4), and a cylindrical bottom member (36) having an outside diameter smaller than the inside diameter of the central channel (5) of the supporting body (4), and which is housed inside the central channel (5); and an elastic annular seal (43) is inserted between an outer surface (41) of the bottom member (36) and an inner surface (42) of the central channel (5).

46. The fuel injector of claim 45 wherein the connector (32) comprises a cylindrical top member (33) having an outside diameter substantially equal to the inside diameter of the feed conduit (31), and an externally threaded end portion which screws inside the feed conduit (31).

* * * * *